US010260689B2

(12) United States Patent
Qiu

(10) Patent No.: US 10,260,689 B2
(45) Date of Patent: Apr. 16, 2019

(54) ADJUSTABLE HEADLIGHT AND APPLICATION THEREOF

(71) Applicant: Ningbo Futai Electric Limited, Ningbo, Zhejiang (CN)

(72) Inventor: Fujun Qiu, Ningbo (CN)

(73) Assignee: Ningbo Futai Electric Limited, Ningbo, Zhejiang (CN)

( * ) Notice: Subject to any disclaimer, the term of this patent is extended or adjusted under 35 U.S.C. 154(b) by 19 days.

(21) Appl. No.: 15/413,348

(22) Filed: Jan. 23, 2017

(65) Prior Publication Data

US 2017/0211759 A1 Jul. 27, 2017

(30) Foreign Application Priority Data

Jan. 22, 2016 (CN) ..... 2016 1 0045278

(51) Int. Cl.

| | |
|---|---|
| ***F21L 4/04*** | (2006.01) |
| ***F21L 4/02*** | (2006.01) |
| ***F21V 21/084*** | (2006.01) |
| ***F21V 21/30*** | (2006.01) |
| ***F21V 23/04*** | (2006.01) |
| *F21V 31/00* | (2006.01) |
| *F21W 111/10* | (2006.01) |
| *F21W 131/20* | (2006.01) |
| *F21W 131/40* | (2006.01) |

(52) U.S. Cl.

CPC ..... *F21L 4/04* (2013.01); *F21L 4/02* (2013.01); *F21V 21/084* (2013.01); *F21V 21/30* (2013.01); *F21V 23/0414* (2013.01); *F21V 23/0428* (2013.01); *F21V 31/00* (2013.01); *F21W 2111/10* (2013.01); *F21W 2131/20* (2013.01); *F21W 2131/40* (2013.01)

(58) Field of Classification Search

CPC .. F21L 4/04; F21L 4/02; F21V 21/084; F21V 21/30; F21V 23/0414; F21V 23/0428; F21V 31/00

See application file for complete search history.

(56) References Cited

U.S. PATENT DOCUMENTS 4,851,974 A * 7/1989 Maglica ..... F21L 4/005 362/187
5,143,441 A * 9/1992 Maglica ..... F21L 4/005 200/60

(Continued)

*Primary Examiner* — Anabel Ton
(74) *Attorney, Agent, or Firm* — Raymond Y. Chan; David and Raymond Patent Firm

(57) ABSTRACT

An adjustable headlight includes a headband and an adjustable illumination device mounted on the headband. The adjustable illumination device includes a light source, a lens, a rotating shell, a first adjuster, a second adjuster, a tubular electrical conductive rack, and a base. The light source is electrically connected to the top end of the tubular electrical conductive rack. The lens is mounted on the front end of the rotating shell. The first adjuster is rotatably connected to the rotating shell. The second adjuster drives the tubular electrical conductive rack to be rotatably coupled with the first adjuster and the base. Rotating the rotating shell changes the distance between the light source and the lens, so as to achieve focus adjustment within the adjustable headlight without changing external length of the device. The device is adapted for being worn on the user's head in various circumstances.

18 Claims, 11 Drawing Sheets

(56) References Cited

U.S. PATENT DOCUMENTS

| | | | | |
|---|---|---|---|---|
| 6,908,208 | B1 * | 6/2005 | Hyde | F21L 4/06 362/105 |
| 7,534,975 | B1 * | 5/2009 | Sharrah | F21L 4/027 200/336 |
| 9,618,827 | B2 * | 4/2017 | Shatz | G03B 15/05 |
| 9,638,404 | B2 * | 5/2017 | Lee | F21V 21/406 |
| 9,829,182 | B1 * | 11/2017 | McCaslin | F21V 21/084 |
| 9,851,080 | B2 * | 12/2017 | Wilt | F21V 21/084 |
| 2002/0034073 | A1 * | 3/2002 | Halasz | F21L 4/00 362/197 |
| 2003/0021105 | A1 * | 1/2003 | Cramer | F21L 14/00 362/105 |
| 2008/0316733 | A1 * | 12/2008 | Spartano | F21L 14/00 362/105 |
| 2009/0323317 | A1 * | 12/2009 | Spartano | F21V 14/065 362/105 |
| 2013/0182423 | A1 * | 7/2013 | Matthews | A45F 5/02 362/191 |
| 2016/0025317 | A1 * | 1/2016 | Lee | F21V 21/0965 362/486 |

* cited by examiner

ADJUSTABLE HEADLIGHT AND APPLICATION THEREOF

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

This invention relates to the field of lighting, and, in particular, to an adjustable headlight and its applications. The adjustable headlight can be focused internally without changing an overall length thereof, which enhances the safety of its utilization.

Description of Related Arts

With the change of lifestyle, people pursue more and more outdoor activities and night activities, and therefore use more portable night illumination tools. A headlight, as a lighting tool that frees people's hands, is different from a regular flashlight that when used as a headlight, the user can still use his/her hands to do more things. Therefore, people love the headlight because of its conveniences in utility and use headlight more that makes it an important and indispensable equipment in daily life and work.

The light intensity of a conventional headlight is fixed. As a result, when users need closer distance illumination, they need use a short range headlight, but when users need relatively far distance illumination, they will have to replace the headlight with a long range and wide scope headlight. That is to say that the users can not randomly change the illumination patterns of the headlight as they like, so that a multifunctional illumination performance cannot be provided, which brings great inconvenience to the users. With the continuous development of technology, the headlight is changed, so that it can meet the lighting needs of a variety of circumstances, including making the distance between a light source and a lens be adjustable for changing a focal length of the headlight, allowing the headlight to provide both of the short range illumination and the long range illumination, and enabling the headlight to change the illumination angle of the light source so that the illumination area becomes adjustable, which renders more and more adjustable headlights into the market, to meet people's needs.

However, the way that conventional light adjustable headlight achieves focusing is to selectively adjust the position of the lens relative to the light source, which also typically alters the distance between the top and bottom ends of the headlight and change the length of the headlight. After that, the headlight may no longer be suitable for putting in pockets and become inconvenient to carry. Also, during the use, once the headlight touches any obstacle, its lighting pattern may change or the headlight may be damaged. As a result, the user has to readjust the headlight and waste a lot of time. Especially if the user's hands are busy, this situation will bring the user much inconvenience, affect his work, and even threat his life. This drawback of conventional light adjustable headlight further limits its application and utility.

Hence, further improvement for light adjustable headlight is urgently needed so as to better serve people's works and lives.

SUMMARY OF THE PRESENT INVENTION

An advantage of the present invention is to provide an adjustable headlight and its applications, wherein the adjustable headlight can be focused internally without changing the overall length thereof, which enhances the safety of its utilization.

Another advantage of the present invention is to provide an adjustable headlight and its applications, wherein the luminous intensity, illumination angle, and the light spot size are all adjustable, so as to meet the needs of various circumstances.

Another advantage of the present invention is to provide an adjustable headlight and its applications, wherein the length and shape remain unchanged during the adjustment of the adjustable headlight, so the waterproof effect of the headlight is good that it functions well on rainy days.

Another advantage of the present invention is to provide an adjustable headlight and its applications, wherein it has a glare mode, a dim mode, and a flashing mode. Besides, the light spot size is adjustable and the range can be altered, such that it can illuminate for close and far ranges so as to satisfy various needs of the users.

Another advantage of the present invention is to provide an adjustable headlight and its applications, wherein the headlight has a wider angle of adjustment so as to have a wider illumination scope, wherein the illumination area is adjustable and changable, which is adapted for various illumination scopes.

Another advantage of the present invention is to provide an adjustable headlight and its applications, wherein after the adjustable headlight is worn on the user's head, the illumination angle of the adjustable headlight can be changed through adjusting the angle between the adjustable illumination device and the headband, such that it can achieve the desired illumination angle without moving the headband, which is convenient and capable of satisfying various needs in terms of illumination angle.

Another advantage of the present invention is to provide an adjustable headlight and its applications, wherein the parts of the adjustable headlight are rotatably coupled and buckled, so its focusing is easy, its anti-dismantling is effective, it allows multiple rotating operations, and it is durable.

Another advantage of the present invention is to provide an adjustable headlight and its applications, wherein it can be charged or its battery can be replaced at any time, such that it has longer illumination hours.

Another advantage of the present invention is to provide an adjustable headlight and its applications, wherein its working modes can be switched by the user with the switch button, which is easy and convenient.

Another advantage of the present invention is to provide an adjustable headlight and its applications, wherein its illumination area and range can be adjusted through turning the rotating shell of the adjustable illumination device, such that the diameter of the light spot is adjustable, which operation is easy and time saving.

Another advantage of the present invention is to provide an adjustable headlight and its applications, wherein it is thin, light, and widely suitable for various circumstances and applications.

Another advantage of the present invention is to provide an adjustable headlight and its applications, wherein the material of the headband of the headlight is soft and adjustable in both longitudinal and circumferential sizes, which is comfortable and easy to use.

In order to achieve at least one of the above object and other objects and advantages of the present invention, the present invention provides an adjustable headlight, comprising: at least one light source; at least one rotating shell; at least one lens, mounted on a front end of the rotating shell; at least one first adjuster, coupled with the rotating shell so as to rotate when the rotating shell is rotated; at least one tubular electrical conductive rack, having a top end thereof electrically connected with the light source; at least one second adjuster, mounted on the tubular electrical conductive rack; and at least one base, comprising a chamber body and an adjustment connecting portion extended from the chamber body, wherein the second adjuster drives the tubular electrical conductive rack to be movably coupled to the first adjuster and move between the chamber body and the adjustment connecting portion, so as to allow the distance between the light source and the lens to be altered by rotating the rotating shell.

According to an embodiment of the present invention, the inner wall of the first adjuster has a spiral guide slot arranged thereon. The second adjuster has two knobs that are circularly movable along the spiral guide slot. The distance between the light source and the lens can be changed by rotating the rotating shell clockwise or counterclockwise.

According to an embodiment of the present invention, the base has two sliding passages. The sliding passages match with the knobs in such a manner that the knobs pass through the sliding passages to engage with the spiral guide slot. The knobs move along the sliding passages and the spiral guide slot, such that the tubular electrical conductive rack, the second adjuster, and the light source can move inside of the base.

According to an embodiment of the present invention, the inner wall of the rotating shell extends to form a rotating track, wherein the outer wall of the first adjuster has a rotating groove, wherein the rotating track and the rotating groove engage with each other to allow the rotation of the rotating shell to drive the first adjuster to rotate.

According to an embodiment of the present invention, the adjustable headlight further comprises a switch. The switch is arranged on the base and electrically connected with the light source. When the switch is switched on, it can adjust the working modes of the adjustable headlight. The working modes comprises of a glare mode, a dim mode, and a flashing mode.

According to an embodiment of the present invention, the adjustable headlight further comprises a headband that comprises a front supporting portion, three connecting bands, and a back supporting portion, wherein the front supporting portion is connected with the base, wherein the back supporting portion is connected with the front supporting portion through the connecting band, wherein the connecting bands allow the adjustable headlight to be worn on the user's head.

According to an embodiment of the present invention, the front supporting portion has a fixing portion and the base has an adjustment portion. The adjustment portion move along the fixing portion to change the angle between the base and the front supporting portion so as to change the illumination angle of the adjustable headlight.

According to an embodiment of the present invention, the adjustable headlight to further comprises a power supply unit. The power supply unit is mounted on the back supporting portion and electrically connected with the tubular electrical conductive rack to supply electric power to the light source.

According to another aspect of the present invention, the present invention also provides an application of an adjustable headlight, wherein the adjustable headlight is focused by moving a light source inside of the adjustable headlight that the external length thereof will not be changed during the focusing process such that the adjustable headlight is adapted for being worn on the user's head and being applied to various circumstances, such as surgery, workshop, outdoor exercise, calling for help, reading, sailing, and exploration.

In order to achieve at least one of the above advantages, the present invention further provides an adjustable headlight, comprising an adjustable illumination device and a headband. The adjustable illumination device comprises a light source, a lens, a rotating shell, a first adjuster, a second adjuster, a tubular electrical conductive rack, and a base. The light source is electrically connected to the top end of the tubular electrical conductive rack. The lens is mounted on the front end of the rotating shell. The first adjuster is coupled to the rotating shell in such a manner that rotation of the rotating shell drives the first adjuster to rotate. The second adjuster, which is rotatably coupled with the first adjuster, is mounted with the tubular electrical conductive rack and rotatably couple the tubular electrical conductive rack with the first adjuster and the base. Rotating the rotating shell changes the distance between the light source and the lens, so as to achieve a focus adjustment within the base. The adjustable illumination device is mounted on the headband.

According to an embodiment of the present invention, the adjustable illumination device comprises a front cover and a lamp cover extended outward from the top wall of the front cover, wherein the lens is mounted under the lamp cover to form a convex lens of the adjustable headlight, wherein the front cover is mounted on the top end of an inside of the rotating shell.

According to an embodiment of the present invention, the adjustable illumination device comprises a front cover integrally formed with the lens.

According to an embodiment of the present invention, the edge of the front cover has a flange and the front end of the rotating shell has a trench extended from the front end of the main body of the rotating shell toward the center thereof, so that when the front cover is mounted on the top end of the rotating shell, the trench can stop the front cover, so as to avoid it from dropping out from the front end of the rotating shell.

According to an embodiment of the present invention, the front cover has a front cover screw connecting portion extended from the bottom thereof. The base has a chamber body and an adjustment connecting portion extended from the top end of the chamber body. The adjustment connecting portion has a base screw connecting portion on the top end thereof. The front cover can be locked and fixed on the base screw connecting portion of the adjustment connecting portion of the base through the front cover screw connecting portion.

According to an embodiment of the present invention, the rotating shell has one or more recesses arranged at the inner wall of the rotating shell. The first adjuster has one or more snap locks arranged on the outer wall of the first adjuster. The recesses of the rotating shell are corresponding to the snap locks of the first adjuster, such that the rotating shell and the first adjuster can be engaged through the matching of the recesses and the snap locks.

According to an embodiment of the present invention, the rotating shell has an internal thread structure arranged on the inner wall of the rotating shell and the first adjuster has an external thread structure arranged on the outer wall of the first adjuster. Therefore, the matching of the internal thread structure and the external thread structure allow the rotating shell and the first adjuster to engage with each other.

According to an embodiment of the present invention, the second adjuster has a second female screw and the tubular electrical conductive rack has a tubular male screw. The second adjuster and the tubular electrical conductive rack are connected through the second female screw and the tubular male screw.

According to an embodiment of the present invention, the first adjuster comprises a first element and a second element, wherein the first element and the second element are buckled respectively at the outer side of the adjustment connecting portion of the base rendering the two knobs of the second adjuster to respectively pass through the two sliding passages to insert into the spiral guide slot.

According to an embodiment of the present invention, the front supporting portion has a fixing portion and the base has an adjustment portion. The adjustment portion move along the fixing portion to change the angle between the base and the front supporting portion so as to change the illumination angle of the adjustable headlight.

According to an embodiment of the present invention, the front supporting portion has a buckling portion that is a protrusion formed by outwardly extending a side of the front supporting portion. When the adjustable illumination device is adjusted to be perpendicular to the front supporting portion through the adjustment portion, the buckling portion can buckle the top end of the base so as to firmly couple the base and the front supporting portion.

According to an embodiment of the present invention the front supporting portion comprises two connecting portions. The connecting portions are arranged on two edges of the front supporting portion and rotatably connected with the two sides of the base, such that the base can rotate around the front supporting portion without separating therefrom, which is safe and convenient.

According to an embodiment of the present invention, the light source is embodied as an LED lamp.

In order to achieve at least one of the above objects, the present invention further provides a method of assembling an adjustable headlight, comprising the following steps.

(a) Arrange the light source on the top end of the tubular electrical conductive rack.

(b) Mount the second adjuster on the tubular electrical conductive rack.

(c) Movably arrange the tubular electrical conductive rack in the base and arrange the two knobs respectively on the two sliding passages.

(d) Arrange the first adjuster on the outer side of the base and arrange the knobs on the spiral guide slot.

(e) Arrange the front cover on the front end of the base.

(f) Mount the first adjuster on the inner side of the rotating shell.

(g) Arrange the adjustable illumination device on the headband.

(h) Arrange the three connecting bands between the front supporting portion and the back supporting portion.

(i) Electrically connect the adjustable illumination device to the power supply unit.

According to step (b) of the method of assembling the adjustable headlight according to an embodiment of the present invention, the second adjuster is locked on the tubular electrical conductive rack by screwing.

According to step (b) of the method of assembling the adjustable headlight according to an embodiment of the present invention, the second adjuster has a second female screw and the tubular electrical conductive rack has a tubular male screw. The second adjuster and the tubular electrical conductive rack are connected through the second female screw and the tubular male screw.

According to step (c) of the method of assembling the adjustable headlight according to an embodiment of the present invention, the base has an adjustment connecting portion extended from the top end of a chamber body, wherein the two sliding passages are located at the adjustment connecting portion and corresponding to the two knobs, wherein the internal space of the chamber body and the adjustment connecting portion is the space for the tubular electrical conductive rack and the second adjuster to move back and forth.

According to step (d) of the method of assembling the adjustable headlight according to an embodiment of the present invention, the spiral guide slot is located on the inner side wall of first adjuster, such that when the two knobs are moving along the spiral guide slots, the relative positions in terms of front and back of the second adjuster and the first adjuster will be changed.

According to step (d) of the method of assembling the adjustable headlight according to an embodiment of the present invention, the first adjuster is mounted on the outer side of the adjustment connecting portion of the base.

According to step (e) of the method of assembling the adjustable headlight according to an embodiment of the present invention, the adjustment connecting portion of the base has a base screw connecting portion on the top end thereof, wherein the front cover can be locked and fixed on the base screw connecting portion of the adjustment connecting portion of the base through a front cover screw connecting portion.

According to step (e) of the method of assembling the adjustable headlight according to an embodiment of the present invention, the lens is arranged in the front cover. When the relative position of the second adjuster to the first adjuster is changed, the relative position of the lens to the light source will be changed, so that focal length can be adjusted.

According to step (e) of the method of assembling the adjustable headlight according to an embodiment of the present invention, the lens and the front cover are formed integrally. When the relative position of the second adjuster to the first adjuster is changed, the relative position of the lens to the light source will be changed, so that focal length can be adjusted.

According to step (f) of the method of assembling the adjustable headlight according to an embodiment of the present invention, the first adjuster is mounted on the rotating shell with a buckle structure.

According to step (f) of the method of assembling the adjustable headlight according to an embodiment of the present invention, the first adjuster is mounted on the rotating shell with a screw structure.

According to step (g) of the method of assembling the adjustable headlight according to an embodiment of the present invention, the base of the adjustable illumination device is detachably mounted on the front supporting portion of the headband.

According to step (i) of the method of assembling the adjustable headlight according to an embodiment of the present invention, the power supply unit is mounted on the back supporting portion of the headband.

According to step (i) of the method of assembling the adjustable headlight according to an embodiment of the present invention, the power supply unit can also be mounted on the adjustable illumination device and the adjustable illumination device with the power supply unit is then mounted on the headband.

In order to achieve at least one of the above objects, the present invention further provides a method of operating and focusing an adjustable headlight, comprising the following steps.

(A) Drive the first adjuster to rotate by means of rotation of the rotating shell.

(B) Guide the two knobs of the second adjuster to move along the spiral guide slot of the first adjuster.

(C) Respectively retain the two knobs by the two sliding passages of the base, wherein the second adjuster moves back and forth relatively to the first adjuster.

(D) Drive the light source that is arranged on the tubular electrical conductive rack to move back and forth with respect to the lens on the top end of the rotating shell by the second adjuster, so as to change the focal length.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1A:
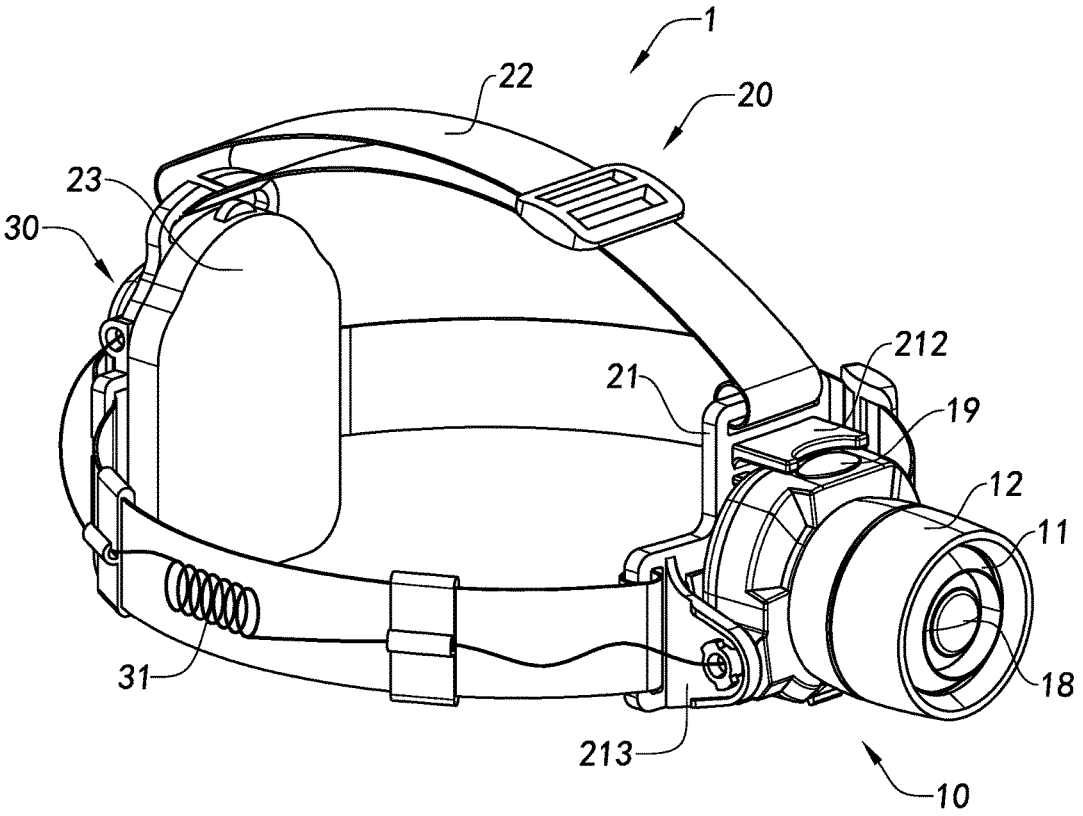
FIGS. 1A and 1B are 3D perspective views of the adjustable headlight according to a preferred embodiment of the present invention.
Figure 1B:
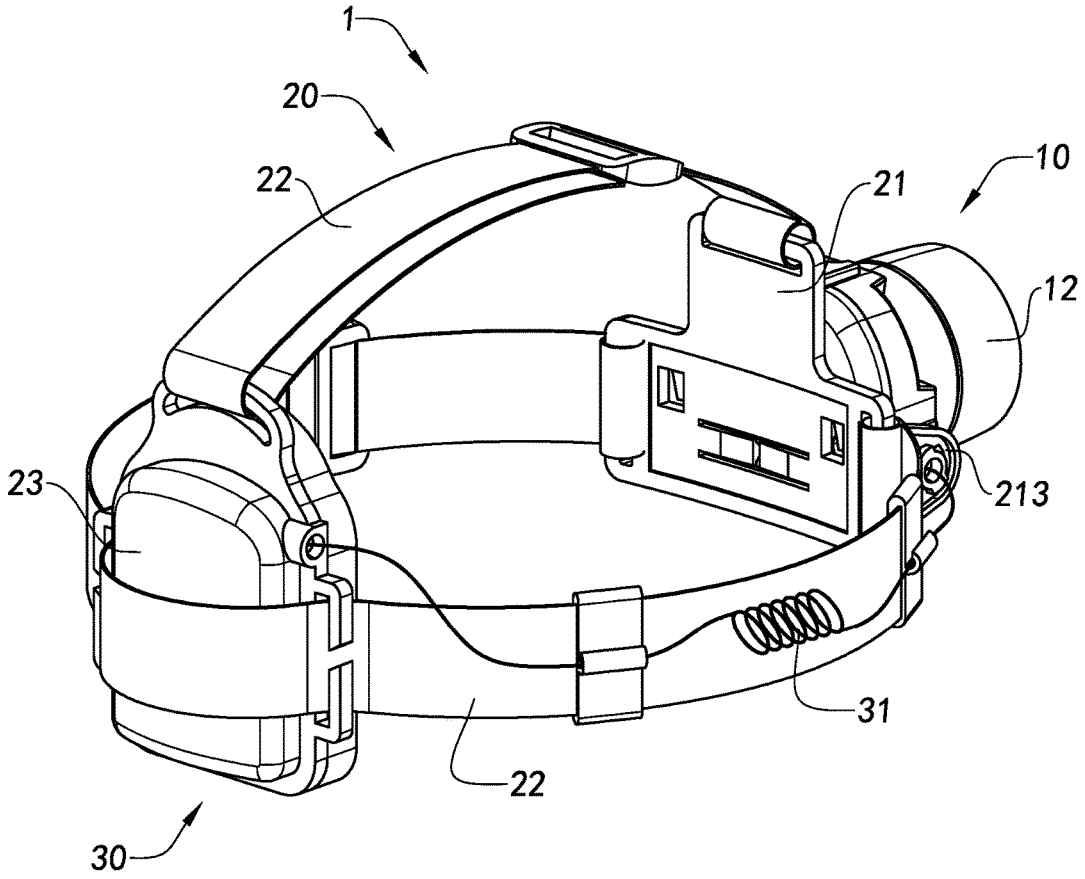
Figure 2:
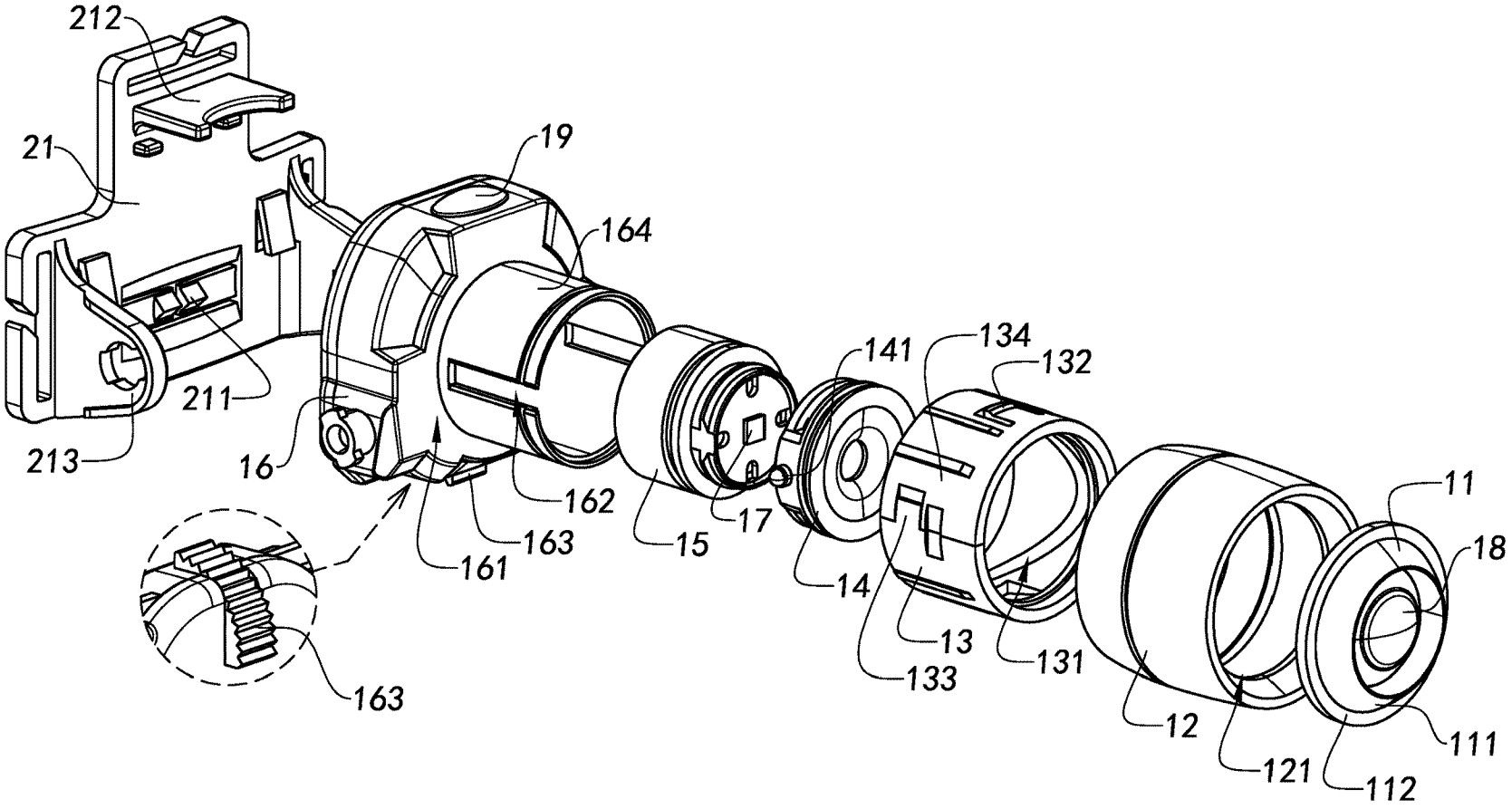
FIG. 2 is an exploded view of the adjustable headlight according to the above preferred embodiment of the present invention.
Figure 3:
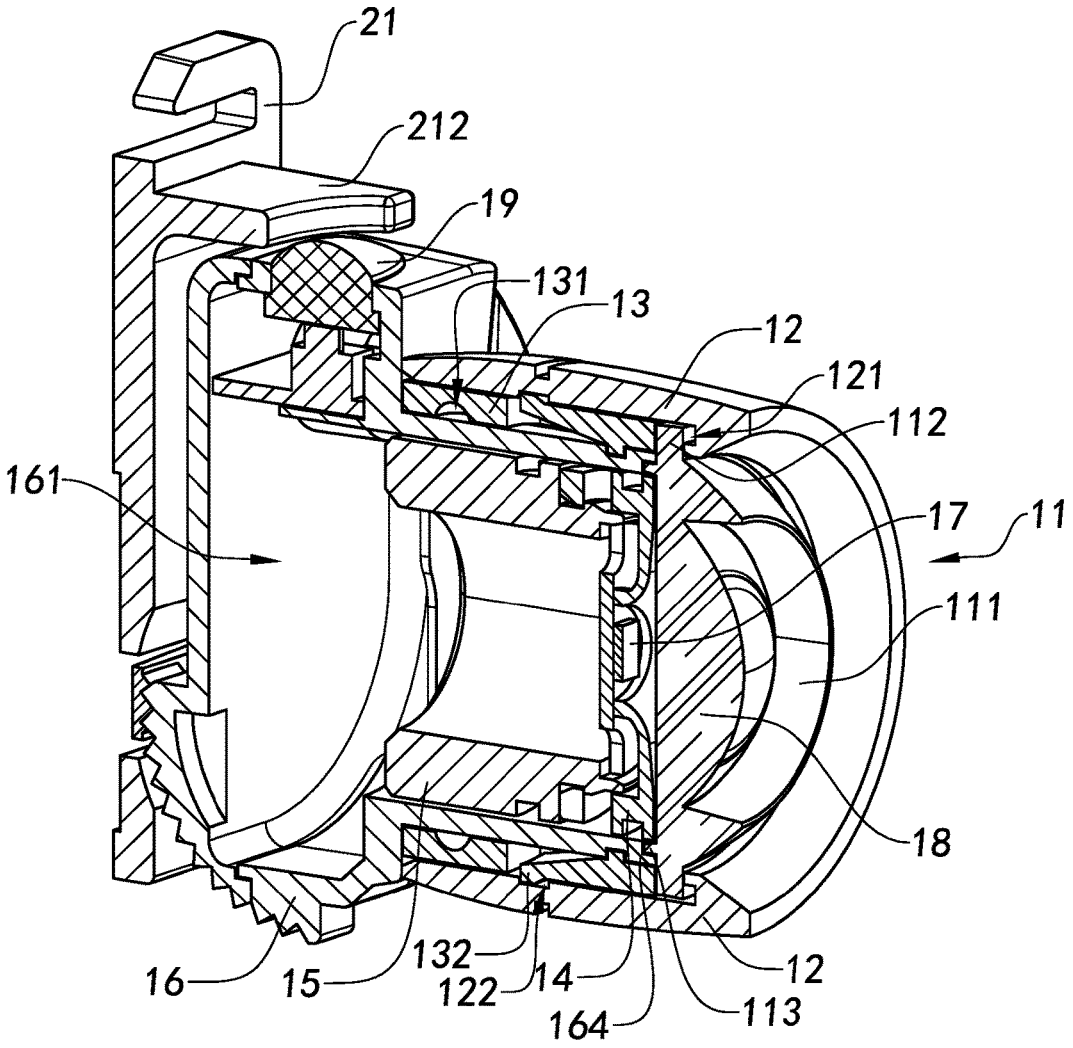
FIG. 3 is a sectional view of the adjustable headlight according to the above preferred embodiment of the present invention, wherein the light source is at the near-end of the lens.
Figure 4:
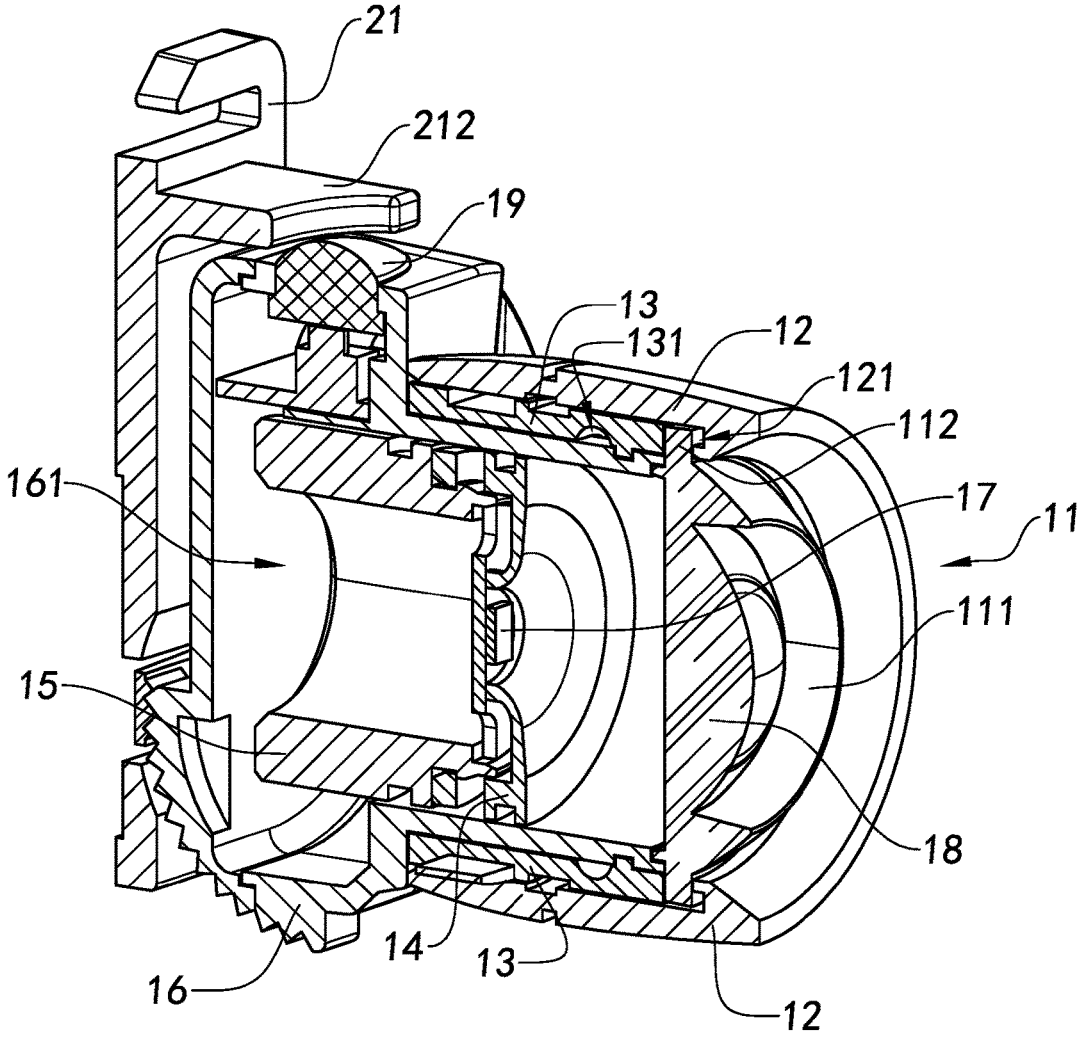
FIG. 4 is a sectional view of the adjustable headlight according to the above preferred embodiment of the present invention, wherein the light source is at the distal end of the lens.
Figure 5:
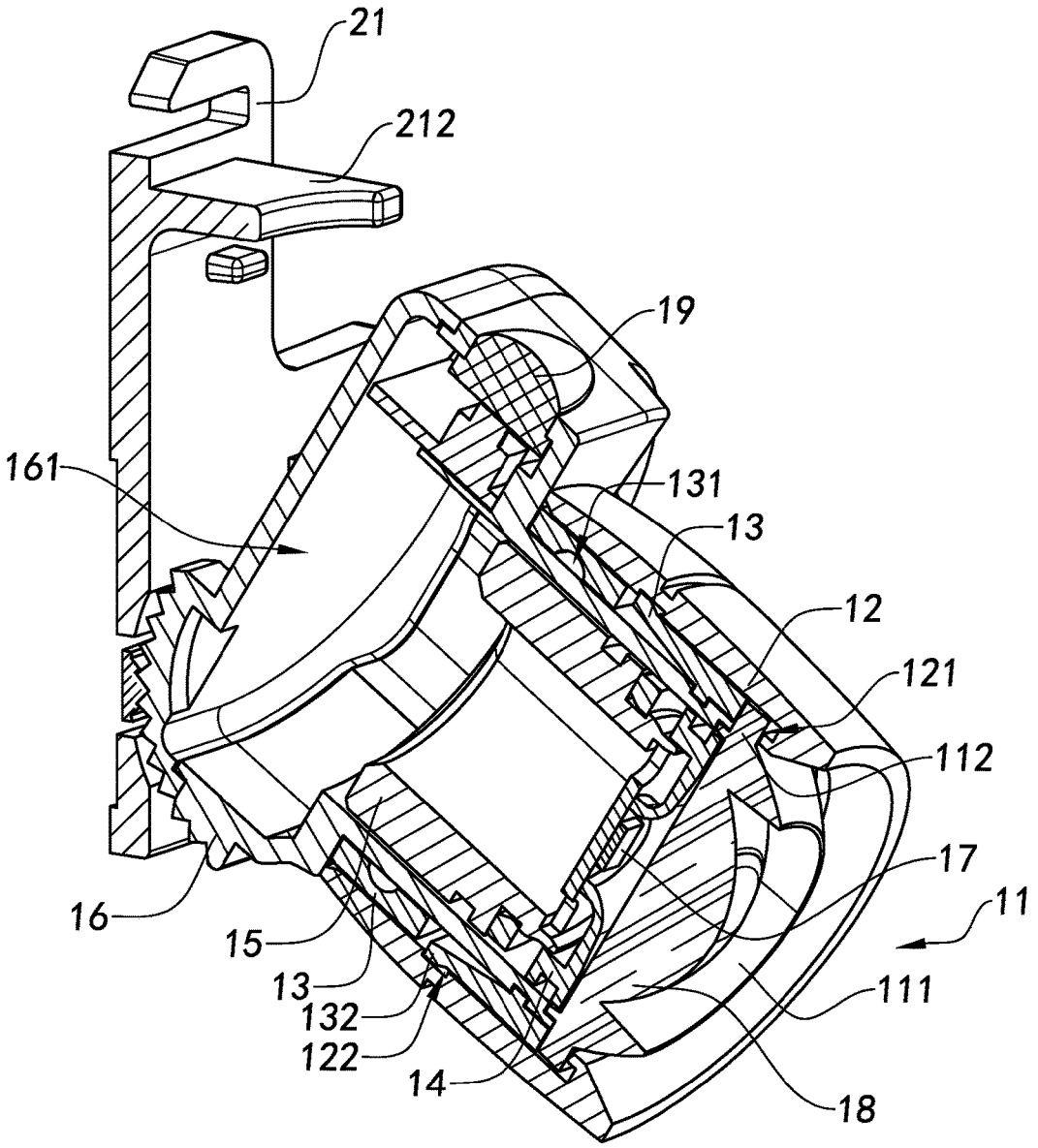
FIG. 5 is a sectional view of the adjustable headlight according to the above preferred embodiment of the present invention, wherein an angle is kept between the adjustable illumination device and the front supporting portion to illustrate that the angle between the adjustable illumination device and the front supporting portion is adjustable.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 1A-5, an adjustable headlight provided by the present invention is illustrated. FIGS. 1A-5 illustrate an adjustable headlight 1 comprising an adjustable illumination device 10, a headband 20, and a power supply unit 30. The headband 20 is connected between the adjustable illumination device 10 and the power supply unit 30. The adjustable headlight 1 is worn on the user's head through the headband 20, so as to illuminate for the user. The power supply unit 30 is arranged on the back of the headband 20 and connected to the adjustable illumination device 10 with a wire 31, so as to provide an electric power thereto. Also, because the power supply unit 30 is located on the back of the user's head, it will not hinder the user's operation. Further, the adjustable illumination device 10 is arranged on the headband 20 and electrically connected with the power supply unit 30, wherein the adjustable illumination device has the functions of light pattern and illumination mode adjustments, so that when the user is wearing the adjustable illumination device 10 on his or her head through the headband 20, he or she can adjust the light pattern and illumination mode based on the environment or needs.

The adjustable illumination device 10 comprises a front cover 11, an electrical conductive rack 15 which is in tubular shape, a base 16, a light source 17, and a lens 18. The lens 18 is mounted within the front cover 11. The light source 17 is mounted on a top end of the tubular electrical conductive rack 15. The tubular electrical conductive rack 15 is connected to the power supply unit 30 through a wire 31, so as to provide the electric power to the light source 17, such that the light projected from the light source 17 can pass through the lens 18 for illumination. The tubular electrical conductive rack 15 is movably arranged in a chamber body 161 of the base 16 and is able to correspondingly move along the chamber body 161, so as to change the distance between the light source 17 and the lens 18 for adjusting the focal length. It is worth mentioning that the lens 18 and the front cover 11 can be integrally formed.

The adjustable illumination device 10 further comprises a rotating shell 12 having a hollow shell body. The front cover 11 is mounted on a top end of the rotating shell 12 with the rotating shell 12. The front cover 11 has a lamp cover 111. The lamp cover 111 is formed by extending the top wall of the front cover 11 outwards. The lens 18 is mounted in the inside of the lamp cover 111 to form a convex lens of the adjustable headlight. Further, the lens 18 can also be integrally formed in the inside of the lamp cover 111.

Besides, an edge of the front cover 11 has a flange 112 and the front end of the rotating shell 12 has a trench 121 extended from the front end of the main body of the rotating shell 12 toward the center thereof, such that when the front cover 11 is mounted on the top end of the rotating shell 12, the trench 121 can stop the front cover 11 so as to avoid it from dropping out from the front end of the rotating shell 12. Further, the flange 112 and the trench 121 are matchably connected or engaged, so as to fix the front cover 11 within the rotating shell 12 and to allow the lens 18 to refract the light out for illumination. In addition, the front end of the rotating shell 12 is in the outside of the front cover 11, which can further protect the lens 18 and enhance the safety of use. Besides, the trench 121 can also be utilized for installing waterproof rings, including o-ring and rubber ring, so as to avoid water from entering the adjustable headlight. Moreover, the bottom end of the front cover 11 and the top end of the base 16 are connected. In other words, the front cover 11 is arranged between the trench 121 of the rotating shell 12 and the top end of the base 16. Preferably, they are connected with screw threads. The front cover 11 can be fixed by the connection of the rotating shell 12 and the base 16. Furthermore, the front cover 11 has a front cover screw connecting portion extended from the bottom thereof. The base 16 has an adjustment connecting portion 164 extended from the top end of the chamber body 161. The adjustment connecting portion 164 has a base screw connecting portion on the top end thereof. The front cover 11 can be locked and fixed on the base screw connecting portion of the adjustment connecting portion of the base 16 through the front cover screw connecting portion.

The adjustable illumination device 10 further comprises a first adjuster 13 and a second adjuster 14, wherein the second adjuster 14 is mounted on the tubular electrical conductive rack 15, wherein two opposite outer sides of the second adjuster 14 outwardly extend to form two knobs 141. The two knobs 141 are able to respectively correspondingly move along the two sliding passages 162 of the base 16. After the knobs 141 pass through the sliding passages 162, they further connect the first adjuster 13 and move along a spiral guide slot 131 of the first adjuster 13. The connection of the knobs 141 and the spiral guide slot 131 renders the rotatable connection between the first adjuster 13 and the second adjuster 14. The first adjuster 13 is further rotatably mounted within the rotating shell 12 and will rotate corresponding to the rotation of the rotating shell 12. Further speaking, the sliding passages are arranged on the two sides of the adjustment connecting portion 164 and corresponding to the two knobs 141. The spiral guide slot 131 is arranged on the inner side of the first adjuster 13, such that when the two knobs 141 are moving along the spiral guide slots 131, the relative positions in terms of front and back of the second adjuster 14 and the first adjuster 13 will be changed. In other words, like cam wheel, when the first adjuster 13 is rotating, the two knobs 141 move on the spiral guide slot 131 and relatively drive the second adjuster 14 to move back and forth. At the same time, the tubular electrical conductive rack 15 will move back and forth along with the second adjuster 14. The two sliding passages 162 are for limiting the knobs 141 in moving back and forth only. Hence, it is understandable that the rotation of the rotating shell 12 will drive the first adjuster 13 to rotate simultaneously and allow the second adjuster 14 to move back and forth under the spacing of the two sliding passages 162 and the spiral guide slot 131, so as to further change the relative positions of the light source 17 that is on the tubular electrical conductive rack 15 and the lens 18 that is arranged on the top end of the rotating shell 12, such that the light pattern can be changed and adjusted. In addition, the second adjuster 14 has a second female screw and the tubular electrical conductive rack 15 has a tubular male screw. The second adjuster 14 and the tubular electrical conductive rack 15 are connected through the second female screw and the tubular male screw. The first adjuster 13 is arranged on the outer side of the adjustment connecting portion 164 of the base 16. The first adjuster 13 comprises a first element 133 and a second element 134. That is, it was formed of two portions. The first element and the second element are respectively buckled on the outer side of the adjustment connecting portion 164 of the base 16 and render the two knobs 141 of the second adjuster 14 respectively pass through the two sliding passages 162 and insert into the spiral guide slot 131, such that when the rotating shell 12 rotates and the first adjuster 13 is simultaneously driven to rotate, the knobs 141 of the second adjuster 14 will move along the spiral guide slot 131 and drive the tubular electrical conductive rack 15 that is connected with the second adjuster 14 to move back and forth. Further, the relative positions of the light source 17 located on the tubular electrical conductive rack 15 and the lens 18 arranged on the top end of the rotating shell 12 will be changed, so as to change and adjust the light pattern.

Specifically, in an embodiment, the inner wall of the rotating shell 12 extends to form a rotating track. The outer wall of the first adjuster 13 comprises a rotating groove arranged thereat. The rotating groove and the spiral guide slot 131 are respectively located on the outer side wall and inner side wall of the first adjuster 13. The size and shape of the rotating groove match the rotating track, such that the rotating shell 12 is connected together by the connecting and engaging of the rotating track and the rotating groove. The rotating track can rotate along the rotating groove clockwise or counterclockwise. In other words, by manually rotate the rotating shell 12, the rotating track will drive the first adjuster 13 to rotate correspondingly. The rotation of the first adjuster 13 also drives the second adjuster 14 to rotate correspondingly. Besides, the above mentioned connection mode between the rotating shell 12 and the first adjuster 13 is not the only mode to be implemented. Rather, they can be connected in other mode(s). For example, referring to the drawings, the rotating shell 12 has one or more recesses 122 arranged at the inner wall of the rotating shell 12. The first adjuster 13 has one or more snap locks 132 arranged on the outer wall of the first adjuster 13. The recesses 122 of the rotating shell 12 are corresponding to the snap locks 132 of the first adjuster 13, such that the rotating shell 12 and the first adjuster 13 can be engaged through the matching of the recesses 122 and the snap locks 132. Alternatively, the rotating shell 12 has an internal thread structure arranged on the inner wall of the rotating shell 12 and the first adjuster 13 has an external thread structure arranged on the outer wall of the first adjuster 13. Therefore, the matching of the internal thread structure and the external thread structure allow the rotating shell 12 and the first adjuster 13 to engage with each other. Therefore, it is understandable that no matter which coordination structure is utilized, it is only to connect the rotating shell 12 and the first adjuster 13, such that when the rotating shell 12 rotates, the first adjuster 13 will be simultaneously driven to rotate. Thus, the knobs 141 of the second adjuster 14 will move on the spiral guide slot 131 and drive the tubular electrical conductive rack 15 that is connected with the second adjuster 14 to move back and forth. Further, the relative positions of the light source 17 located on the tubular electrical conductive rack 15 and the lens 18 arranged on the top end of the rotating shell 12 will be changed, so as to change and adjust the light pattern.

It is worth mentioning that the spiral guide slot 131 is arranged on the inner side wall of the first adjuster 13 in a spiral-shaped manner, so as to allow the knob 141 to spirally move along the spiral guide slot 131 and therefore allow the second adjuster to freely rotate along the inner wall of the first adjuster 13. The second adjuster 14 can move for unlimited cycles and drive the tubular electrical conductive rack 15 to move inside of the chamber body 16 to bring the light source 17 to move correspondingly, such that the distance between the light source 17 and the lens 18 can be changed.

The adjustable illumination device 10 further comprises a switch 19, installed on a side of the base 16. When the adjustable illumination device is worn on the user's head, the switch 19 will be located on the top, so that turning on and off the adjustable headlight 1 and adjust the working mode of the adjustable headlight 1 are easier. The switch 19 is electrically connected with the power supply unit 30 and the tubular electrical conductive rack 15, so as to control the on and off of the light source 17.

Figure 6:
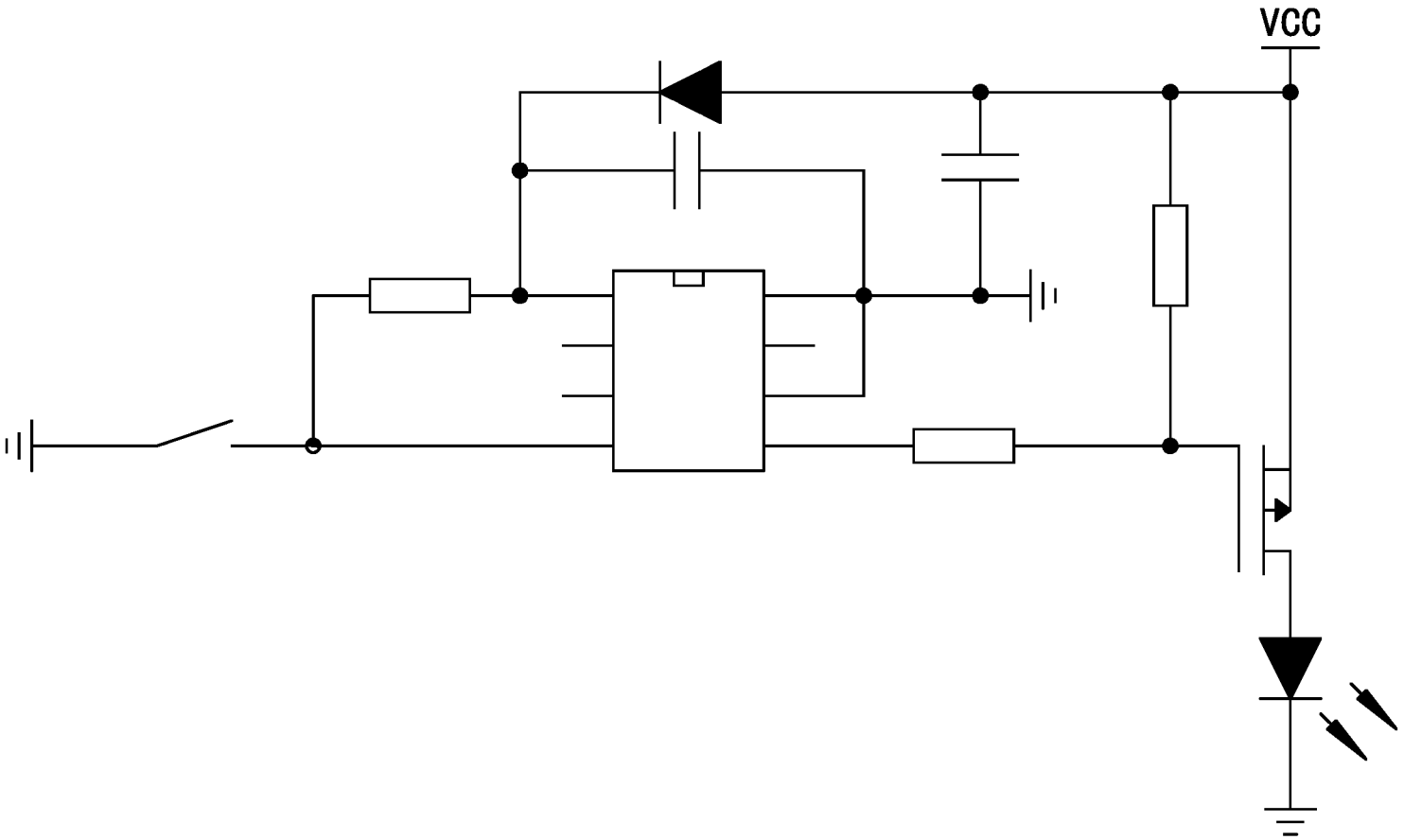
FIG. 6 is a perspective view of the circuit structure of the adjustable headlight according to the above preferred embodiment of the present invention.

The adjustable headlight 1 has three working modes, which are respectively a glare mode, a dim mode, and a flashing mode, which circuit structure is illustrated in FIG. 6. Pressing the switch 19 can adjust the working mode of the adjustable headlight 1. For example, one single press of the switch 19 activates the glare mode, continuous two press operations of the switch 19 activates the dim mode, and continuous three press operations of the switch 19 activates the flashing mode (or the SOS mode). The user can select the mode as he or she need, in which the operation is simple and easy. In addition, the user can also adjust the working mode of the adjustable headlight 1 by pressing the switch 19 in the following control manner. More specifically, a press of the switch 19 activates the glare mode, the next press activates the dim mode, and the next press activates the flashing mode (or the SOS mode). Nevertheless, the way of utilizing the switch 19 to switch the working mode of the adjustable headlight shall not limit the present invention.

When the switch 19 is turned on, the light source 17 will project light. The light will pass through the lens 18 to emit out to form an illumination spot in a certain size, wherein the diameter of the spot can be freely adjusted to meet the needs in various circumstances. Specifically, when it needs to change the size of the spot, it can rotate the rotating shell 12. The rotation of the rotating shell 12 will bring the first adjuster 13 to rotate, such that the knobs 141 will slide along the sliding passages 162. When the knobs 141 simultaneously spirally slide along the spiral guide slot 131 of the first adjuster 13, the second adjuster 14 will move in the chamber body 161 and bring the tubular electrical conductive rack 15 that is connected therewith to move, so as to change the distance between the light source 17 and the lens 18. Different distance between them renders different spot diameters, which achieve the object of allowing focusing within the adjustable headlight 1 without altering the overall length of the adjustable headlight.

Figure 7A:
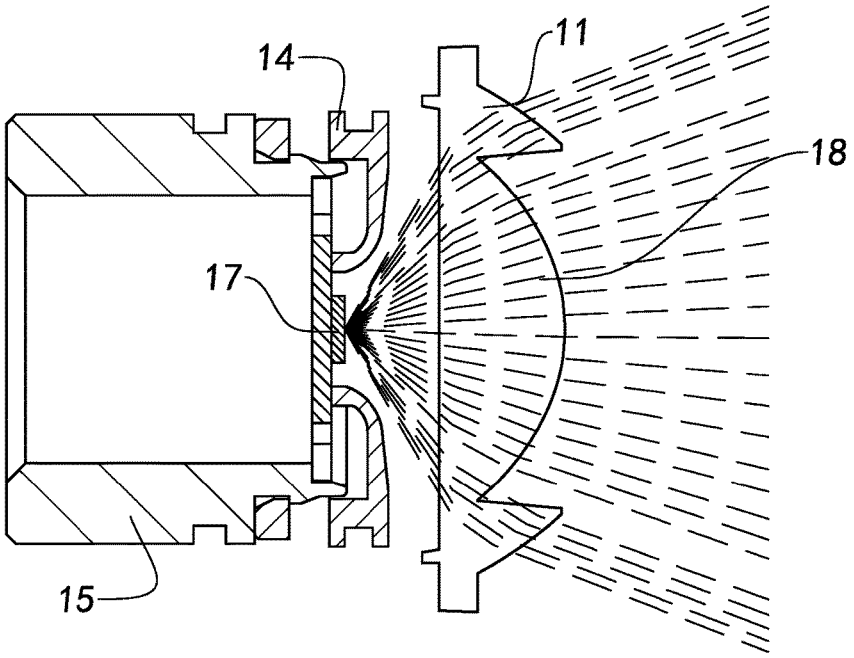
FIGS. 7A and 7B are perspective views of the light paths of the adjustable headlight according to the above preferred embodiment of the present invention.
Figure 7B:
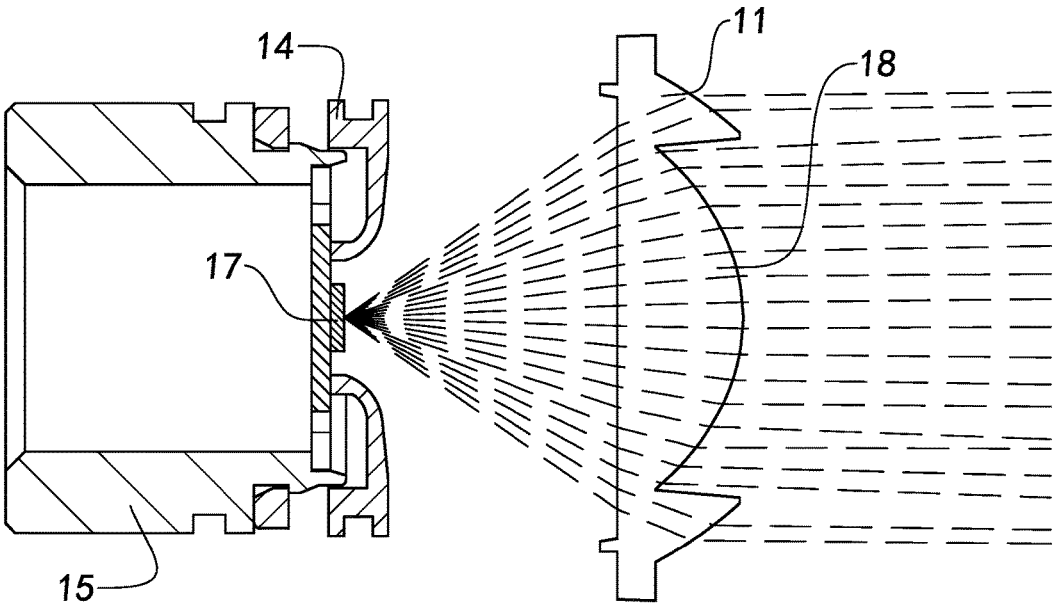

Referring to FIGS. 7A and 7B, during the focusing process, when the distance between the light source 17 and the lens 18 changes, the light projection angle changes. For example, as FIG. 7A illustrated, when the distance between the light source 17 and the lens 18 is maintained within a relatively small predetermined range, the light emitted by the light source 17 will be refracted into divergent light after it passes through the lens 18. Nonetheless, as FIG. 7B illustrated, when the distance between the light source 17 and the lens 18 is maintained within a relatively large predetermined range, the light emitted by the light source 17 will be refracted into parallel light after it passes through the lens 18. In other words, when the light source 17 is at a distal end or away from the lens 18, the light passed through the lens becomes parallel light. Therefore, the degree of light condensation and range of the adjustable headlight 1 can further be changed, so as to alter its illumination area and allow the illumination scope to be adjusted in a continuous manner within a certain limit, such that the needs of various circumstances can all be satisfied.

It is worth mentioning that because the sliding passages 162 are formed by extending the top end of the base 16 toward the bottom end of the base 16, the knobs 141*b* can both slide from the top end of the sliding passage 162 to the bottom end thereof and slide from the bottom end of the sliding passage 162 to the top end thereof. Also, the spiral guide slot 131 allows the knobs 141 to both rotate from the top end of the first adjuster 13 to the bottom end thereof and rotate from the bottom end of the first adjuster 13 to the top end thereof during the rotation. Therefore, the rotating shell 12 can both clockwise rotate and counterclockwise rotate to freely change the distance between the light source 17 and the lens 18 according to the needs without altering the external length of the adjustable illumination device 10. Besides, external impact will not change the length and render deviation of the focusing result of the device in use. Therefore, the device is safer and better in terms of waterproof. In other words, both clockwise rotation and counterclockwise rotation of the rotating shell 12 move the light source 17 and reciprocate the distance between the light source 17 and the lens 18. Thus, unlimited loop of rotating the rotating shell 12 can be utilized to adjust the light source within the adjustable headlight 1 and it allows many times of adjustment. It is durable and easy to adjust, which makes the adjustable headlight 1 thin, small, and portable.

Further, the top ends of the rotating shell 12, the first adjuster 13, the second adjuster 14, the tubular electrical conductive rack 15, and the base 16 are all cylinder-shaped that facilitates free rotation during the focusing process. The connections between the parts utilize buckling to prevent from disassembling and allow several times of rotation. They are very robust, waterproof, fall-resistant, and cold-resistant, which makes the adjustable headlight 1 durable.

The headband 20 comprises a front supporting portion 21, three connecting bands 22, and a back supporting portion 23. The front supporting portion 21 is connected to the bottom of the base 16. The connecting bands 22 are spacingly connected between the front supporting portion 21 and the back supporting portion 23, wherein three of the connecting bands 22 form a triangular arrangement of support, or a three fulcrum connection structure, so that it is easy to wear on the user's head. Moreover, it can prevent the headband 20 from falling, which is very safe. It is worth mentioning that the length of the connecting band 22 can be freely regulated so as to be suitable for different users. Besides, the connecting band 22 can further be made of flexible material, which makes the user more comfortable and helps the user to put it on and off. The bottom shape of the front supporting portion 21 applies ergonomics design, to fit the shape of human's forehead. It also made of low hardness material, so as to make the wearing more comfortable. The bottom shape of the back supporting portion 23 as well applies ergonomics design, to fit the shape of human's hindhead. It also made of low hardness material, so as to make the wearing more comfortable and protect the person's head from injuring.

Besides, the three connecting bands 22 can also be embodied as one or two connecting bands 22, which is to utilize one connecting band 22 for the connection around and between the front supporting portion and the back supporting portion or to utilize two connecting bands 22 to be respectively connected on a side of the front supporting portion and the back supporting portion to form a ring structure that is suitable to be worn. Hence, it is understandable that the quantity of the connecting bands 22 shall not limit the present invention.

The front supporting portion 21 has a fixing portion 211, arranged on the side that the front supporting portion contacts the base 16. The base 16 further has an adjustment portion 163. The adjustment portion 163 is arranged on the bottom and side portion of the bottom end of the base 16. The adjustment portion 163 is arranged to be a sliding rail form to slide along the fixing portion 211. When it arrives a predetermined position, it can be fixed by the fixing portion 211 and further allow the angle between the adjustable illumination device 10 and the front supporting portion 21 to be changed. The range of the angle change is 0°-90°. In other words, the coordination between the adjustment portion 163 and the fixing portion 211 can allow the angle between the adjustable illumination device 10 and the front supporting portion 21 be freely changed between 0°-90°, such that when the user wears the adjustable headlight 10 on his head, he can regulate the angle of the headlight 10 with the adjustment portion 163 according to the needed illumination angle and consist the optical axis to his sight, which achieves co-axial illumination that helps to ease the user's eye strain and satisfy his illumination demand. It is worth mentioning that the fixing portion 211 of the front supporting portion 21 is embodied as at least one fixing tooth and the adjustment portion 163 of the base 16 is embodied as a multi-tooth structure. As a result, when the adjustment portion 163 is rotate relatively to the fixing portion 211, each tooth of rotation changes the angle between the adjustable illumination device 10 and the front supporting portion 21.

It is also worth mentioning that the switch 19, the rotating shell 12, and the adjustment portion 163 are all in the front part of the adjustable headlight 1, such that the adjustments of the working mode, the spot, and the angle of the adjustable headlight 1 can all be made in the front part of the adjustable headlight 1, which is easy and allows adjustment based on the real situations, so as to satisfy the needs of various circumstances.

The front supporting portion 21 further has a buckling portion 212 that is a protrusion formed by extending a side of the front supporting portion 21 outward. When the adjustable illumination device 10 is adjusted to be perpendicular to the front supporting portion 21 through the adjustment portion 163, the buckling portion 212 can buckle the top end of the base 16 so as to firmly couple the base 16 and the front supporting portion 21. However, they can also be separated by external force, so as to further adjust the angle between the adjustable illumination device 10 and the front supporting portion 21.

The front supporting portion 21 further comprises two connecting portions 213. The connecting portions 213 are arranged on two edges of the front supporting portion 21 and rotatably connected with the two sides of the base 16, such that the base 16 can rotate around the front supporting portion 21 without separating therefrom, which is safe and convenient.

The power supply unit 30 is mounted within the back supporting portion 23 and connected to the tubular electrical conductive rack 15 through the wire 31, so as to provide electric power for the light source 17. That is, the power supply unit 30 is arranged at the back of the adjustable headlight 1 and will be on the back of the user's head when worn, which will not influence the use. Further, the wire 31 extends to the base 16 along one of the connecting band 22 and pass through a side portion of the base 16 to further extend to the inside of the chamber body 161 and to be connected to the tubular electrical conductive rack 15.

According to an embodiment of the present invention, the power supply unit 30 can be embodied as an accumulator cell, which can be replaced freely and repeatedly charged. Therefore, the user can prepare many pieces of cells for the replacement in emergency situation and for long time illumination, which is especially suitable for outdoor sporters. In addition, the power supply unit 30 can also provide the light source 17 power by direct charging.

Further, the adjustable illumination device 10 is arranged to comprise a camera, so as to provide a video recording function. For instance, it can record a surgery when worn during the operation to keep evidence and relieve tension between doctor and patient. Besides, it helps doctor to study further based on each operation, which boost medical development.

The light source 17 can be embodied as LED with stronger penetrability that, based on the actual needs, it can optionally be lamps with various colors, including red, blue, white, yellow, etc., so as to project different colors and satisfy various needs.

Figure 8A:
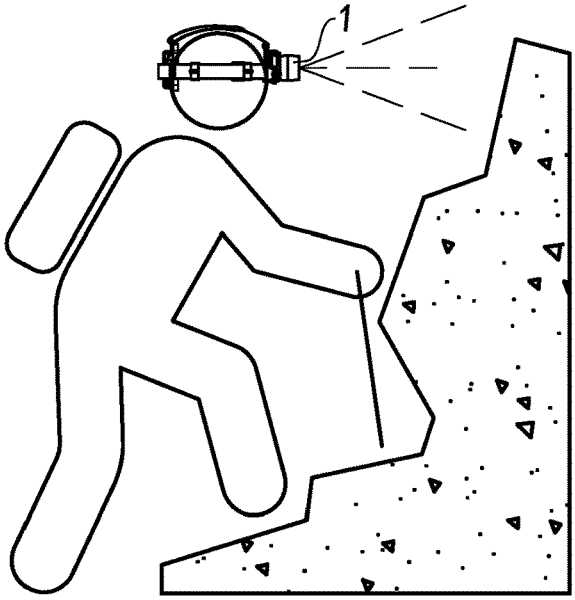
FIG. 8A is a perspective view of a first application of the adjustable headlight according to the above preferred embodiment of the present invention.

Referring to FIG. 8A, the adjustable headlight provided by the present invention is utilized in mountaineering. Mountaineering is one of the outdoor activities that people love. However, when mountaineering, illumination device is necessary, so as to provide illumination during the nighttime for the user if it is late. Because the size of the adjustable headlight 1 provided by the present invention is smaller and thinner, it is easy to carry with. Hence, mountaineer can make it a necessary lamp to carry with. Contrasting to other lamps, it eases the weight. When mountaineering at night, he can wear the adjustable headlight on his head without hindering both of his hand from conducting other activities. Thus, it is easy to use, and allows brightness adjustment that helps to ensure the user's safety.

Figure 8B:
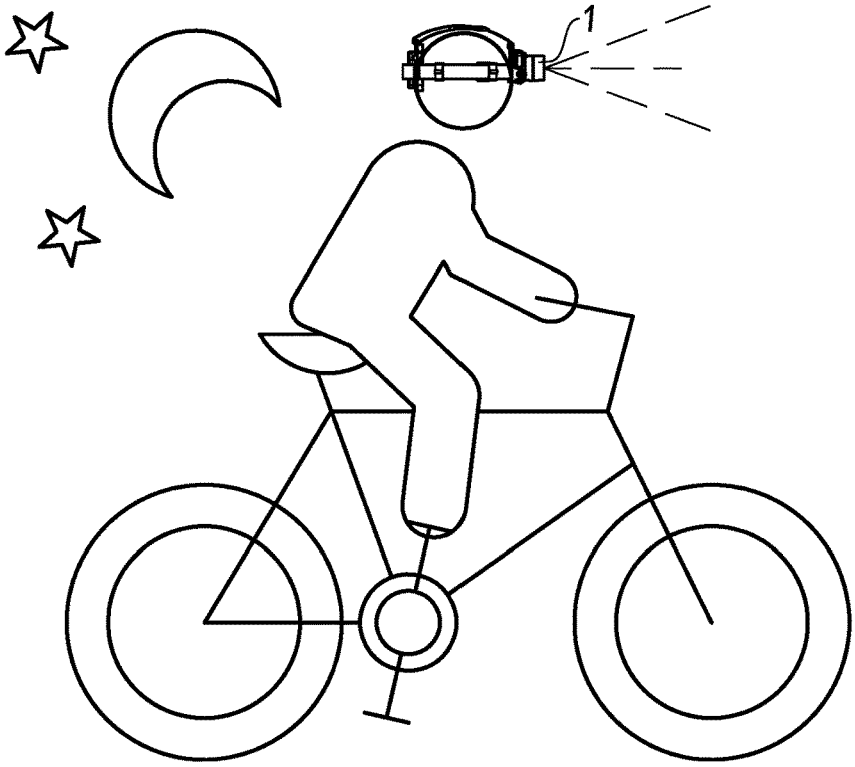
FIG. 8B is a perspective view of a second application of the adjustable headlight according to the above preferred embodiment of the present invention.

Referring to FIG. 8B, the adjustable headlight 1 provided by the present invention is utilized in nighttime biking to substitute the head lamp of the bicycle to illuminate for the user. As the lifestyle changes, more and more people like to ride outdoors, especially in the night with better air. Many cyclists is never bored, but because most routes are sparsely populated, the road lighting is not complete and there could be completely dark road. Therefore, lighting is an essential item of cyclists. The conventional lighting does not have the functions of dimming and waterproofing, but the adjustable headlight provided by the present invention has the functions of dimming and waterproofing. By riding with the adjustable headlight at night, the rider can not only be provided illumination, but also freely switch among the three modes of glare mode, dim mode, and flashing mode. Besides, he or she can adjust the spot size to change its lighting area. For example, when a long-range exposure is needed, the spot can be made smaller and the use of strong light helps the user to see the front clearly. Also, the headlight is worn on the rider's head, so the rider can change the position of the head to illuminate the place that needs illumination. The adjustable headlight is waterproof, so as to continue to illuminate for the rider even if it encounters rainy weather. If the rider only wants to notice his presence to the pedestrians, vehicles, etc. on the road, he can switch the adjustable headlight into flashing mode, which not only saves power, but also reminds other vehicles on the road to pay attention and stay away so as to ensure a smooth and safe riding.

Figure 8C:
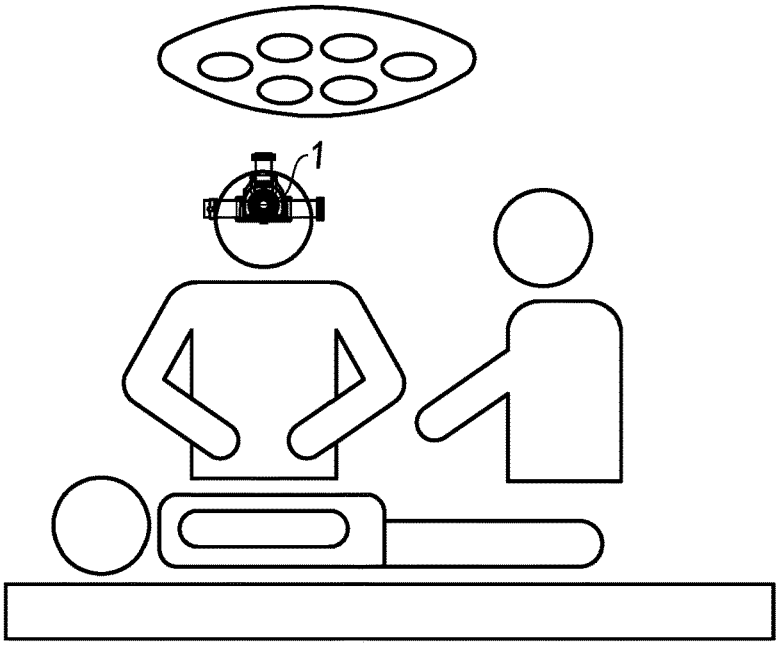
FIG. 8C is a perspective view of a third application of the adjustable headlight according to the above preferred embodiment of the present invention.

Referring to FIG. 8C, the adjustable headlight provided by the present invention is utilized in surgery, which helps physician to practice local surgery. When a doctor is practicing surgery, there can be sudden power failure. In such case, he or she will need emergency lighting equipment to illuminate, so as to ensure a successful surgery. In addition, in spite of power failure, many surgeries that doctors implement are local surgery that require continuous illumination adjustment during the operation. When the local margin of the surgery needs sufficient brightness from the light source, conventional headlights cannot meet the need. Rather, it requires other medical personnel to handle the illumination nearby, which is very inconvenient. However, if the brightness of the headlights cannot be adjusted, and the doctor's vision is poor or the wound is smaller or deeper, when the doctor bows to surgery, a single main lamp can not allow the doctor to see the lesion and surgical conditions clearly, which will affect the surgery. Besides, if the whole surgery process needs the doctor to constantly adjust his posture and angle of practicing, it can make the doctor feel visual fatigue, resulting in fatigue of the doctor, which can threat the patient's life in serious cases. Fortunately, the use of the adjustable headlight provided by the present invention can solve the above issues. It is very convenient for the doctor wear the adjustable headlight on the head to practice surgery. During the operation, the doctor turns his head so that the headlight can clearly illuminate for him. He can also adjust the adjustment portion 163 according to the actual situation, so as to change the angle between the adjustable illumination device 10 and the headband 20, which is to change the angle between the base 16 and the front supporting portion 21, such that the illumination angle of the adjustable headlight 1 can satisfy the required illumination angle for the operation process. The doctor only needs to conduct minor adjustments, which is simple and convenient. The operation efficiency can therefore be improved. Besides, the brightness, illumination area, and range of the adjustable headlight can all be adjusted according to different surgical situations, which reduce the work loads of the medical staff and to alleviate their eye fatigue. The omission of the medical staff holding the lighting also provides a safe environment for surgery.

When an ENT doctor is checking for a patient, if he does not use headlight, he will have to hold a lamp on one of his hand or have other health care personnel to hold the lamp to illuminate, so that he can check the disease, which brings inconvenience to the doctor. It is possible to solve this problem by wearing the adjustable headlight provided by the present invention. Then, the doctor can adjust for a required brightness according to the need, and directly check the disease by moving his head, which improves the efficiency and frees both of his hands for other activities.

Figure 8D:
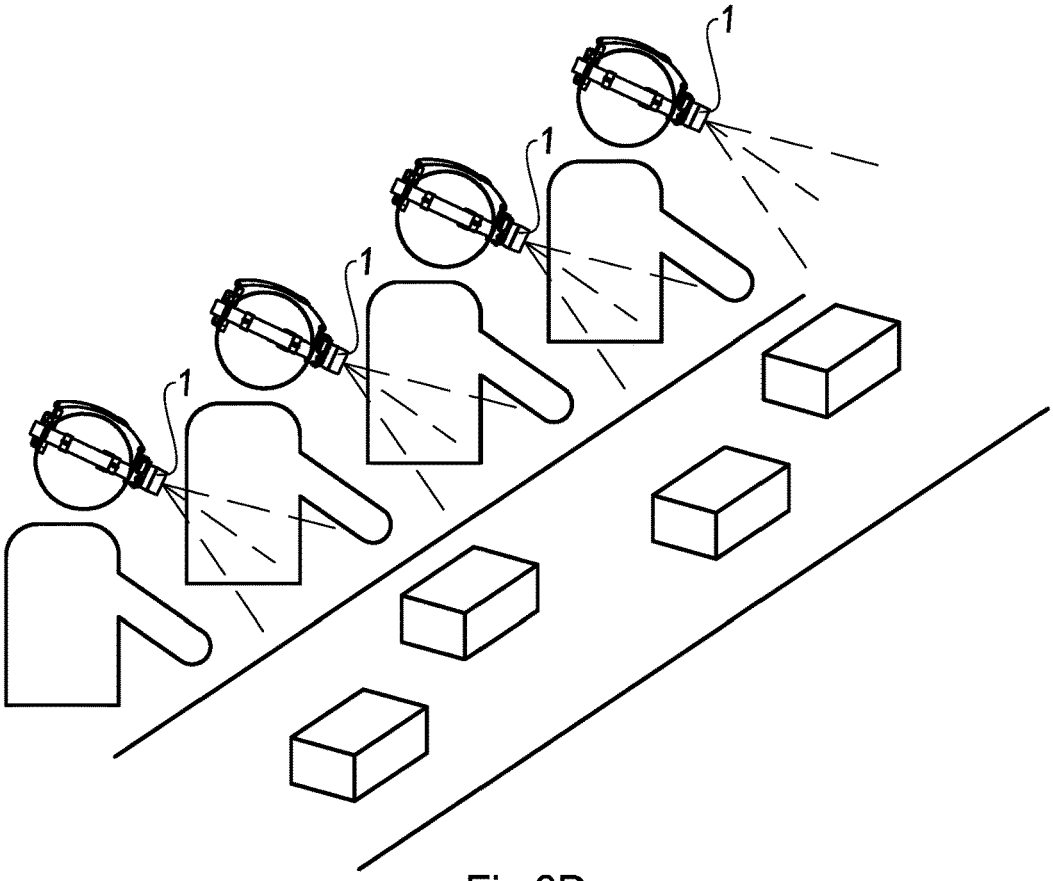
FIG. 8D is a perspective view of a fourth application of the adjustable headlight according to the above preferred embodiment of the present invention.

Referring to FIG. 8D, the adjustable headlight 1 provided by the present invention is utilized in a workshop, so as to help the workers to conduct quality control of the products. In the production process, quality control before the products leave the factory is an indispensable step to ensure the quality of the product, but the product testing can also be a very tedious and troublesome step, especially for some electronic products, because of its small size, light weight, etc. It is very inconvenient in checking their exterior, so the labor is quite intense for the workers. Nonetheless, the use of the adjustable headlight provided by the present invention can provide great convenience for product testing. The adjustable headlight may be worn on the heads of the workers, adjusted between high and low light depending on the needs of illumination intensity, and changed for the size of the spot and range according to the need for its illuminated area. In order to make required brightness and illumination area, so that the worker can clearly see the product and conduct product inspection, the worker can twist his head or changing the distance between his head and the product without manually changing the distance between the lighting device and the product, which greatly reduce the working intensity of the workers.

Figure 8E:
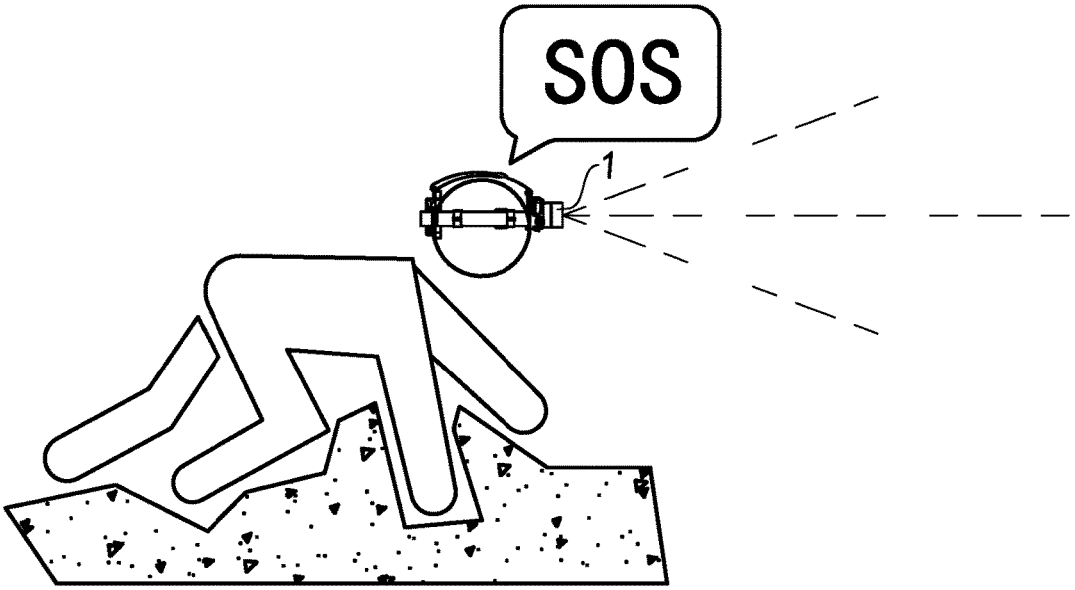
FIG. 8E is a perspective view of a fifth application of the adjustable headlight according to the above preferred embodiment of the present invention.

Referring to FIG. 8E, the adjustable headlight 1 provided by the present invention is utilized to call for help. If the user has an accident, he can call for help by employing the flashing mode of the adjustable headlight, which helps the rescuer to find him timely. An outdoor sporter can have an accident during the night exercise, such as a climber or cyclist get lost, injury, etc. in the middle of nowhere. In order to ensure his own safety, the sporter usually calls for emergency help, but if it is a dark night, the rescuers often have difficulty to timely find the victim. Nevertheless, if the victim has the adjustable headlight provided by the present invention and regulate the adjustable headlight into the flashing mode, the rescuer can easily find the trapped person according to the flickering light, so that the victim can be successfully rescued. Also, the outdoor sporter does not have to be equipped with a special SOS lighting device, but only wear the adjustable headlight during the nighttime outdoor exercise. The adjustable headlight can not only provide illumination for him, but also send out distress signal in the event of an accident. It is a light with multi-purpose, which reduces the loading of the belonging of the outdoor sporter and provides great convenience for outdoor activities.

It is worth mentioning that the above applications are only to give examples, rather than limit the present invention. The adjustable headlight provided by the present invention has multiple advantages. It can also be applied in many daily life and work circumstances, including camping, navigation, tourism, maintenance, reading, fishing, hunting, mining, military and police tactics, etc., which is suitable for military personnel, skiers, police, explorers, doctors, mining workers, cyclists, and various other populations to use.

Besides, the present invention also provides a method of assembling an adjustable headlight 1, comprising the following steps:

(a) arranging the light source 17 on the top end of the tubular electrical conductive rack 15;

(b) mounting the second adjuster 14 on the tubular electrical conductive rack 15;

(c) movably arranging the tubular electrical conductive rack 15 in the base 16 and arranging the two knobs 141 respectively on the two sliding passages 162;

(d) arranging the first adjuster 13 on the outer side of the base 16 and arranging the knobs 141 on the spiral guide slot 131;

(e) arranging the front cover 11 on the front end of the base 16;

(f) mounting the first adjuster 13 on the inner side of the rotating shell 12;

(g) arranging the adjustable illumination device 10 on the headband 20;

(h) arranging the three connecting bands 22 between the front supporting portion 21 and the back supporting portion 23; and (i) electrically connecting the adjustable illumination device 10 to the power supply unit 30.

It is worth mentioning that the assembling order of the above steps is not absolute. Rather, it can be adjusted according to the processing, which shall not limit the present invention.

According to step (b), the second adjuster 14 is locked on the tubular electrical conductive rack 15 by screwing.

According to step (c), the base 16 has an adjustment connecting portion 164 extended from the top end of a chamber body 161, wherein the two sliding passages 162 are located on the adjustment connecting portion and corresponding to the two knob 141. The internal space of the chamber body 161 and the adjustment connecting portion 164 is the space for the tubular electrical conductive rack 15 and the second adjuster 14 to move back and forth.

According to step (d), the spiral guide slot 131 is located on the inner side wall of first adjuster 13, such that when the two knobs 141 are moving along the spiral guide slots 131, the relative positions in terms of front and back of the second adjuster 14 and the first adjuster 13 will be changed.

According to step (d), the first adjuster 13 is arranged on the outer side of the adjustment connecting portion 164 of the base 16. The first adjuster 13 can be embodied as being assembled by at least two parts, so as to form on the outer side of the adjustment connecting portion 164 of the base 16.

According to step (e), the adjustment connecting portion 164 of the base 16 has a base screw connecting portion on the top end thereof. The front cover 11 can be locked and fixed on the base screw connecting portion of the adjustment connecting portion 164 of the base 16 through the front cover screw connecting portion.

According to step (e), the lens 18 is arranged within the front cover 11, wherein when the relative position of the second adjuster 14 to the first adjuster 13 is changed, the relative position of the lens 18 to the light source 17 will be changed as well, so that the focal length can be adjusted.

According to step (e), the lens 18 and the front cover 13 are integrally formed, wherein when the relative position of the second adjuster 14 to the first adjuster 13 is changed, the relative position of the lens 18 to the light source 17 will be changed as well, so that the focal length can be adjusted.

According to step (f), the first adjuster 13 is mounted on the rotating shell 12 with a buckle structure.

According to step (f), the first adjuster 13 is mounted on the rotating shell 12 with a screw structure.

According to step (g), the base 16 of the adjustable illumination device 10 is detachably mounted on the front supporting portion 21 of the headband 20.

According to step (i), the power supply unit 30 is mounted on the back supporting portion 23 of the headband 20.

According to step (i), the power supply unit 30 can also be mounted on the adjustable illumination device 10 and the adjustable illumination device 10 with the power supply unit 30 is then mounted on the headband 20.

Besides, the present invention also provides a method of operating and focusing an adjustable headlight 1, comprising the following steps:

(A) driving the first adjuster 13 to rotate by means of rotation of the rotating shell 12;

(B) guiding the two knobs 141 of the second adjuster 14 to move along the spiral guide slot 131 of the first adjuster 13;

(C) respectively retaining the two knobs 141 by the two sliding passages 162 of the base 16, wherein the second adjuster 14 moves back and forth relatively to the first adjuster 13; and (D) driving the light source 17 that is arranged on the tubular electrical conductive rack 15 to move back and forth with respect to the lens 18 on the top end of the rotating shell 12 by the second adjuster 14, so as to change the focal length.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An adjustable headlight, comprising:

at least one light source;

at least one rotating shell;

at least one lens, mounted on the front end of said rotating shell;

at least one first adjuster, rotatably connected with said rotating shell, wherein an inner wall of said first adjuster has a spiral guide slot arranged thereon;

at least one tubular electrical conductive rack, having a top end thereof electrically connected with said light source;

at least one second adjuster, mounted on said tubular electrical conductive rack, wherein said second adjuster has two knobs that are circularly movable along said spiral guide slot; and at least one base, comprising a chamber body and an adjustment connecting portion extended from said chamber body, wherein said second adjuster drives said tubular electrical conductive rack to be movably coupled to said first adjuster and move between said chamber body and said adjustment connecting portion, wherein a distance between said light source and said lens to be altered by rotating said rotating shell clockwise or counterclockwise.

2. The adjustable headlight, as recited in claim 1, wherein said base has two sliding passages that match said knobs that pass through said sliding passages to engage with said spiral guide slot of said first adjuster, wherein said knobs move along said sliding passages and said spiral guide slot, such that said tubular electrical conductive rack, said second adjuster, and said light source can move inside of said chamber body.

3. The adjustable headlight, as recited in claim 2, wherein an inner wall of said rotating shell extends to form a rotating track, wherein an outer wall of said first adjuster has a rotating groove, wherein said rotating track and said rotating groove engage with each other to allow the rotation of said rotating shell to drive said first adjuster to rotate.

4. The adjustable headlight, as recited in claim 2, further comprising a switch, arranged on said base and electrically connected with said light source, wherein when said switch is switched on, it allows working mode adjustment of the adjustable headlight, wherein the working modes comprises of a glare mode, a dim mode, and a flashing mode.

5. The adjustable headlight, as recited in claim 3, further comprising a switch, arranged on said base and electrically connected with said light source, wherein when said switch is switched on, it allows working mode adjustment of the adjustable headlight, wherein the working modes comprises of a glare mode, a dim mode, and a flashing mode.

6. The adjustable headlight, as recited in claim 4, further comprising a headband that comprises a front supporting portion, three connecting bands, and a back supporting portion, wherein said front supporting portion is connected with said base, wherein said back supporting portion is connected with said front supporting portion through said connecting band, wherein said connecting bands allow said adjustable headlight to be worn on the user's head.

7. The adjustable headlight, as recited in claim 5, further comprising a headband that comprises a front supporting portion, three connecting bands, and a back supporting portion, wherein said front supporting portion is connected with said base, wherein said back supporting portion is connected with said front supporting portion through said connecting band, wherein said connecting bands allow said adjustable headlight to be worn on the user's head.

8. The adjustable headlight, as recited in claim 7, wherein said front supporting portion has a fixing portion and said base has an adjustment portion, wherein said adjustment portion moves along said fixing portion to change the angle between said base and said front supporting portion so as to change the illumination angle of said adjustable headlight.

9. The adjustable headlight, as recited in claim 8, further comprising a power supply unit, mounted on said back supporting portion and electrically connected with said tubular electrical conductive rack to supply electric power to said light source.

10. An adjustable headlight, comprising:

at least one light source;

at least one rotating shell;

at least one lens, mounted on the front end of said rotating shell;

at least one first adjuster, rotatably connected with said rotating shell;

at least one tubular electrical conductive rack, having a top end thereof electrically connected with said light source;

at least one second adjuster, mounted on said tubular electrical conductive rack;

at least one base, comprising a chamber body and an adjustment connecting portion extended from said chamber body, wherein said second adjuster drives said tubular electrical conductive rack to be movably coupled to said first adjuster and move between said chamber body and said adjustment connecting portion, so as to allow a distance between said light source and said lens to be altered by rotating said rotating shell; and a switch, arranged on said base and electrically connected with said light source, wherein when said switch is switched on, it allows working mode adjustment of the adjustable headlight, wherein the working modes comprises of a glare mode, a dim mode, and a flashing mode.

11. The adjustable headlight, as recited in claim 10, wherein an inner wall of said first adjuster has a spiral guide slot arranged thereon, wherein said second adjuster has two knobs that are circularly movable along said spiral guide slot, wherein the distance between said light source and said lens is changed by rotating said rotating shell clockwise or counterclockwise.

12. The adjustable headlight, as recited in claim 10, further comprising a headband that comprises a front supporting portion, three connecting bands, and a back supporting portion, wherein said front supporting portion is connected with said base, wherein said back supporting portion is connected with said front supporting portion through said connecting band, wherein said connecting bands allow said adjustable headlight to be worn on the user's head.

13. The adjustable headlight, as recited in claim 11, further comprising a headband that comprises a front supporting portion, three connecting bands, and a back supporting portion, wherein said front supporting portion is connected with said base, wherein said back supporting portion is connected with said front supporting portion through said connecting band, wherein said connecting bands allow said adjustable headlight to be worn on the user's head.

14. The adjustable headlight, as recited in claim 12, wherein said front supporting portion has a fixing portion and said base has an adjustment portion, wherein said adjustment portion moves along said fixing portion to change the angle between said base and said front supporting portion so as to change the illumination angle of said adjustable headlight.

15. The adjustable headlight, as recited in claim 13, wherein said front supporting portion has a fixing portion and said base has an adjustment portion, wherein said adjustment portion moves along said fixing portion to change the angle between said base and said front supporting portion so as to change the illumination angle of said adjustable headlight.

16. The adjustable headlight, as recited in claim 14, further comprising a power supply unit, mounted on said back supporting portion and electrically connected with said tubular electrical conductive rack to supply electric power to said light source.

17. The adjustable headlight, as recited in claim 15, further comprising a power supply unit, mounted on said back supporting portion and electrically connected with said tubular electrical conductive rack to supply electric power to said light source.

18. An adjustable headlight, comprising:

at least one light source;

at least one rotating shell;

at least one lens, mounted on the front end of said rotating shell;

at least one first adjuster, rotatably connected with said rotating shell;

at least one tubular electrical conductive rack, having a top end thereof electrically connected with said light source;

at least one second adjuster, mounted on said tubular electrical conductive rack; and at least one base, comprising a chamber body and an adjustment connecting portion extended from said chamber body, wherein said second adjuster drives said tubular electrical conductive rack to be movably coupled to said first adjuster and move between said chamber body and said adjustment connecting portion, so as to allow a distance between said light source and said lens to be altered by rotating said rotating shell, wherein said adjustable headlight is focused by moving a light source inside of said adjustable headlight that an external length thereof will not be changed during the focusing process, such that said adjustable headlight is adapted for being worn on the user's head and being applied to various circumstances.

* * * * *